US006174146B1

(12) United States Patent
Lacy et al.

(10) Patent No.: US 6,174,146 B1
(45) Date of Patent: Jan. 16, 2001

(54) ELECTRIC BILGE PUMP ASSEMBLY

(75) Inventors: Graham Lacy; David Edgerley, both of London (GB); Alastair Eves, Bangor; Norman Rehill, Holywood, both of (IE)

(73) Assignee: Munster Simms Engineering Limited (GB)

( * ) Notice: Under 35 U.S.C. 154(b), the term of this patent shall be extended for 0 days.

(21) Appl. No.: 09/135,363

(22) Filed: Aug. 17, 1998

(30) Foreign Application Priority Data

Aug. 18, 1997 (GB) ..... 97 17 405

(51) Int. Cl.[7] ..... F04B 17/00

(52) U.S. Cl. ..... 417/423.15; 417/423.14; 417/423.9

(58) Field of Search ..... 417/423.14, 423.15, 417/423.9, 423.8, 366, 44.1, 36

(56) References Cited

U.S. PATENT DOCUMENTS 3,717,420 * 2/1973 Rachocki ..... 417/12
4,013,383 * 3/1977 Rule ..... 417/366
4,645,426 * 2/1987 Hartley et al. ..... 417/38
5,833,437 * 11/1998 Kurth et al. ..... 417/36

* cited by examiner

*Primary Examiner*—Noah P. Kamen
*Assistant Examiner*—Mahmoud M. Gimie
(74) *Attorney, Agent, or Firm*—Ronald E. Greigg; Edwin E. Greigg

(57) ABSTRACT

An electric bilge pump for collecting liquid found in a bottom of a vessel or any other place. The pump is formed of three parts in axial alignment. The assembly is secured to a surface in substantially a horizontal position. An electric motor is enclosed in a cylindrical jacket and has an output shaft with an impeller at its distal end. A second part of the housing is tubular and defines a chamber with the impeller in the chamber. The chamber has an axial inlet with a tangential outlet. A filter is fitted over the inlet to filter out any unwanted debris.

24 Claims, 2 Drawing Sheets

ELECTRIC BILGE PUMP ASSEMBLY

This invention relates to an electric bilge pump assembly for use in collecting liquid at the bottom of a vessel, a container, a gulley or like structure for holding liquid or in which liquid can gather. The pump is of the centrifugal type having an impeller mounted on the end of a shaft to be driven by an electric motor, the impeller being housed in a chamber having an axial inlet and a tangential outlet. The pump is for integration into a liquid conveying system for liquid disposal or further processing.

Accordingly, the present invention is an electric bilge pump assembly formed of three elongate parts in axial alignment, the assembly being for fixing to a surface in a horizontal attitude or substantially so, the assembly comprising as a first part an electric motor with an output shaft carrying at its distal end an impeller, as a second part a casing having a tubular portion in which is defined a chamber with an axial inlet and a tangential outlet with the impeller being positioned in the chamber, the casing having means for surface securement, and as a third part an inlet housing for fitment over the axial inlet of the casing, the housing having an open arcuate side over which a filter grid is attached.

Preferably, the electric motor is enclosed in a cylindrical jacket whose axis is aligned with the shaft and the axis of the tubular portion of the casing. The jacket preferably has an integral double skin cylindrical outer wall to provide an internal passageway between the skins and into which passageway liquid in the casing can flow to cool the motor.

Preferably, also, the casing has two opposed ends, one in which the axial inlet is provided and the other being open and around which a shroud outwardly extends. The shroud desirably has a plurality of open-ended slots provided at the transition between the tubular portion and itself and into which slots corresponding lugs, provided on the jacket manually are pushed and rotated for the motor to be thereby held in position. At the outer edge of the outer skin of the jacket, an O-ring seal is desirably provided whereby with the lugs fully located in their respective slots, the O-ring is compressed and distorted to provide a liquidtight seal. The shroud is preferably of rectangular shape in end elevation of the casing and two adjoining walls thereof are beneficially extended and provided with apertures through which fastenings can be screwed or bolted into a surface, the wall extensions and apertures serving as the means for surface-securement.

Preferably further, the inlet housing has a body having an upright wall in which an outlet is provided having a projecting spigot surround, the outer circumferential surface of which has a channel providing a seat for an O-ring seal. The end of the casing having the axial inlet is desirably provided with an annular socket formed by an outer peripheral flange and an inner peripheral surround extending from around the axial inlet, the space therebetween being entered by the spigot surround. The outer edge of the outer peripheral flange is beneficially tapered from outside to inside to provide a ramp to assist in the compression of the O-ring seal to provide a liquid tight joint between the casing and inlet housing. The fitment between spigot of the inlet housing with O-ring seal and the socket of the casing, preferably allows the facility to manually adjust the attitude of the filter grid of the housing relative to the surface to which the assembly is attached. The upright wall is, in inner end view, of sectoral shape and the front outer end slopes downwardly from adjacent to the top of the upright wall to meet and partially serve to define a bottom open arcuate side. An air bleed valve preferably is provided in the top side between the top of the upright wall and front outer end.

A tubular extension module of the jacket of the motor is preferably provided, the tubular extension being secured to the jacket by a locking ring and sealed internally with an O-ring. Further, for an automatic version of the pump assembly, a water level detector is preferably provided and housed in the extension. The electric motor beneficially has electric wires extending from the motor for integration into an electric circuit, the wires passing through the tubular extension module along an axial path or substantially so to exit therefrom through an axial collar with a liquidproof seal being provided between wires and collar. The collar has desirably two diametrically-extending wing gussets between itself and the end wall of the tubular extension module to give it support and to aid in disassembly. Two water-level sensors are preferably provided in a spaced relationship in the end wall of the tubular extension module to be located, in use, above the wing gussets, one above each wing gusset.

BRIEF DESCRIPTION OF THE DRAWINGS

An embodiment of the present invention will now be described, by way of example, with reference to the accompanying drawings, in which.

DETAILED DESCRIPTION

Figure 1:
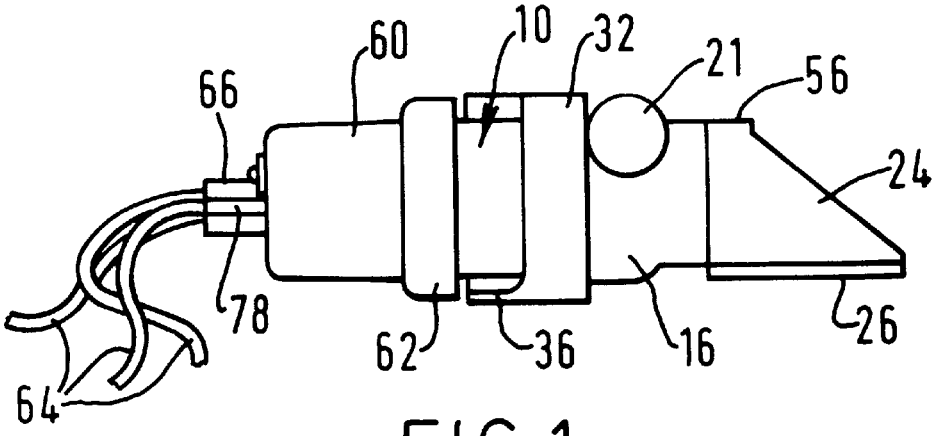
FIG. 1 is a side view of an electric bilge pump assembly according to the present invention.
Figure 2:
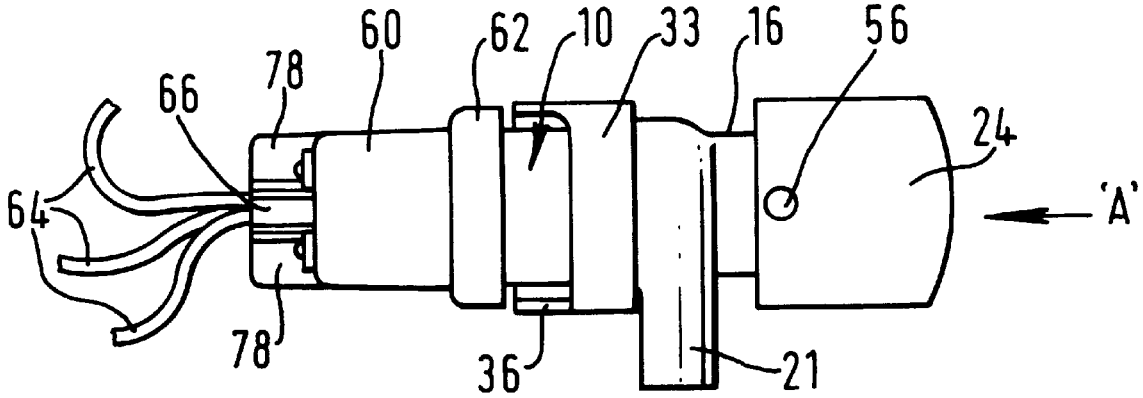
FIG. 2 is a plan view of the pump assembly.
Figure 3:
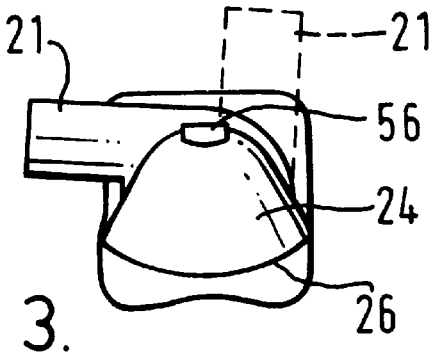
FIG. 3 is an end view of the pump assembly in the direction of arrow 'A'.
Figure 4:
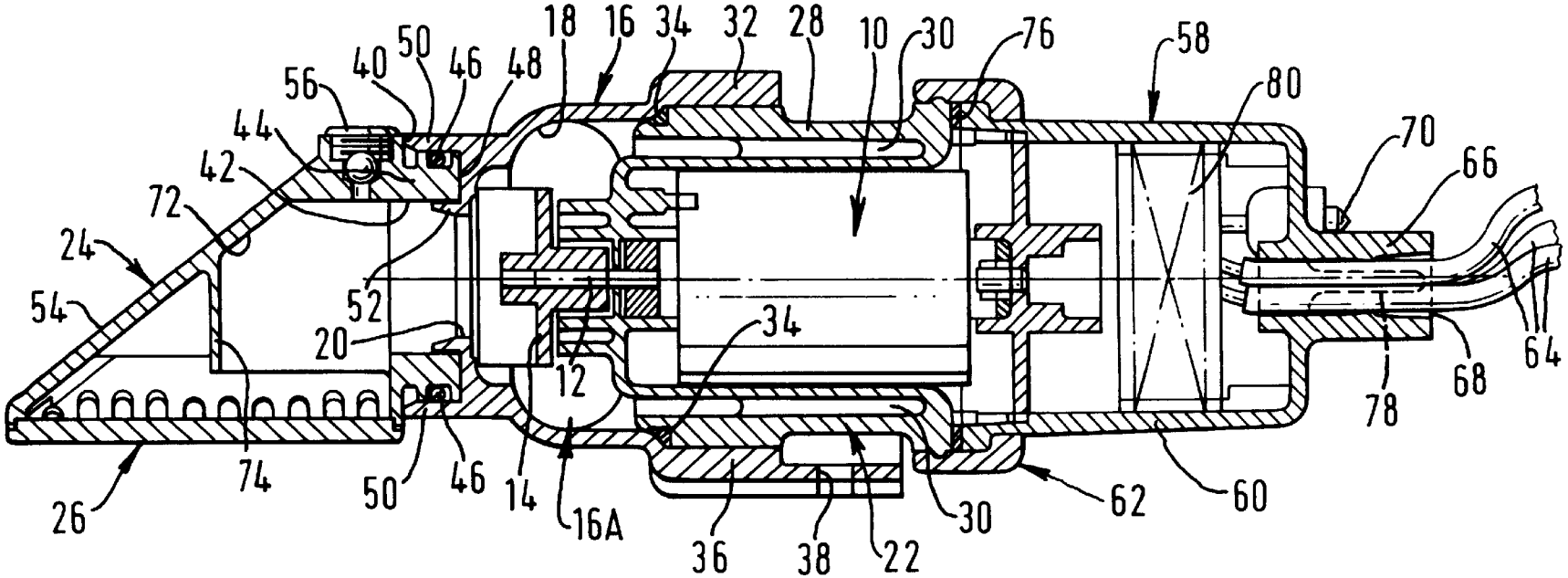
FIG. 4 is a cross-sectional view of an electric bilge pump assembly of the present invention.

Referring to the drawings, an electric bilge pump assembly is formed of three elongate parts in axial alignment. The assembly is for fixing to a surface in a horizontal attitude or substantially so. The assembly comprises as a first part an electric motor (10) with an output shaft (12) carrying at its distal end an impeller (14), as a second part a casing (16) having a tubular portion in which is defined a chamber (18) with an axial inlet (20) and a tangential outlet (21) with the impeller (14) being positioned in the chamber(18), the casing (16) having means for surface securement, and as a third part an inlet housing (24) for fitment over the axial inlet (20) of the casing (16). The housing (24) has an open arcuate side over which a filter grid (26) is removably attached to the housing for ease in cleaning the filter grid.

The electric motor (10) is enclosed in a cylindrical jacket (22) whose axis is aligned with the shaft (12) and the axis of the tubular portion (16A) of the casing (16). The jacket (22) has an integral double skin cylindrical outer wall (28) to provide an internal passageway (30) between the skins and into which passageway (30) liquid in the casing (16) can flow to cool the motor (10).

The casing (16) has two opposed ends, one in which the axial inlet (20) is provided and the other being open and around which a shroud (32) outwardly extends. The shroud (32) has a plurality of open-ended slots (not shown) provided at the transition between the tubular portion (16A) and itself into which slots corresponding lugs (not shown), provided on the jacket (22), are engagable. Each slot has a guideway (not shown) at its open end into which the lugs are manually pushed and rotated into the respective slot for the motor to be thereby held in position. At the outer edge of the outer skin of the jacket (22), an O-ring seal (34) is provided whereby with the lugs fully located in their respective slots. the O-ring seal (34) is compressed and distorted to provide a liquidtight seal. The shroud (32) is of rectangular shape in end elevation of the casing (16) and two adjoining walls (36) thereof are extended and provided with apertures (38) through which fastenings can be screwed or bolted into a surface, the wall extensions (36) and apertures (38) serving as the means for surface-securement.

The inlet housing (24) has a body having an upright wall (40) in which an outlet (42) is provided having a projecting spigot surround (44), the outer circumferential surface of which has a channel providing a seat for an O-ring seal (46). The end of the casing (16) having the axial inlet is provided with an annular socket (48) formed by an outer peripheral flange (50) and an inner peripheral surround (52) extending from around the axial inlet (20), the space therebetween being entered by the spigot surround (44). The outer edge of the outer peripheral flange (50) is tapered (as shown) from outside to inside to provide a ramp to assist in the compression of the O-ring seal (46) again to provide a liquidtight joint between the casing (16) and inlet housing (24). The fitment, between spigot surround (44) of the inlet housing (24) with O-ring seal (46) and the socket (48) of the casing (16), allows the facility to manually adjust the attitude of the filter grid (26) relative to the surface to which the assembly is attached. The upright wall (40) is, in inner end view, of sectoral shape and the front outer end (54) slopes downwardly from adjacent to the top of the upright wall (40) to meet and partially serve to define a bottom open arcuate side. An open-bottomed compartment (72) is provided inside the housing and is defined by a U-shaped partition wall (74), the limbs of which are rooted with one to each side of the outlet (42), the top of the partition being rooted to the top side and the front outer end of the housing. An air bleed valve (56) is provided in the top side between the upright wall (40) and front outer end (54) for air bleeding from the compartment (72).

A tubular extension module (60) of the jacket (28) of the motor is provided, the tubular extension module (60) being secured to the jacket (28) by a locking ring (62) and sealed internally with an O-ring (76). A water level detector (58) is provided for an automatic version of the pump assembly. The detector (58) is housed in the extension. The water level detector circuitry includes time delays, motor stall cut-out protection, thermal overheating cut-out protection and sensing circuitry to provide ON/OFF switching for the motor (10). The electric motor (10) has electric wires (64) extending from the motor (10) for integration into an electric circuit, the wires passing through the tubular extension module (60) along an axial path or substantially so, or parallel thereto, to exit therefrom through an axial collar (66) with a liquidproof seal (68) being provided between wires (64) and collar (66). A terminal board (80) is interposed in the electric wires of the motor and is housed in the tubular extension module. The terminal board (80) has two sets of components, one set on each planar side of the board whereby on assembly of the pump, the board (80) can be used either way up depending upon which one of two alternative axial-lengthed motors is to be used. The difference in axial length relates to the output of the motor, the greater lengthed motor being of higher output. The collar (66) has two diametrically-extending wing gussets (78) between itself and the end wall of the tubular extension module (60) to give support and to aid disassembly. Two water-level sensors or probes (70) are provided in a spaced relationship in the end wall of the tubular extension module (60) to be located, in use, above the wing gussets (78), one above each wing gusset (78). The sensors (70) are rods of non-corroding material mounted in bosses, the rods having polished conical ends.

The inlet housing, the grid, the casing, the jacket, the impeller, locking ring and tubular extension module are of plastics material.

In use, a pump assembly is horizontally positioned in a water craft where liquid is anticipated to be deepest with the two sensors of the water level detector horizontal. First the casing and motor are separated and the casing as described above is secured to a surface by screws or the like and then the motor is re-connected to the casing. If necessary, the inlet housing is rotated to locate the filter grid into the deepest part of the liquid to be removed. The grid has a plurality of slots for passage of liquid therethrough but of width to prevent entry to foreign bodies which could damage the impeller. When the motor is de-energised, the grid is readily cleaned simply by pulling off the housing to rinse the grid, and then fitting the housing and correctly positioning the grid again. Additionally, the grid can be unclipped from the body for a more thorough cleaning, then re-clipping it to the housing before fitting the housing back onto the casing.

Variations and modifications can be made without departing from the scope of the invention described above and as claimed hereinafter.

We claim:

1. An electric bilge pump assembly formed of three elongate parts in axial alignment, the assembly comprising as a first part an electric motor with an output shaft carrying an impeller at a distal end of said shaft, as a second part a casing surrounding said electric motor and said impeller and having a tubular portion in which a pump chamber is defined with an axial inlet and a tangential outlet with the impeller being positioned in the chamber, the casing having mounting means for securing the pump assembly to a fixed side surface and as a third part an inlet housing for fitting over the axial inlet of the casing, the housing having an open arcuate side over which a filter grid is attached for easy removal, said housing being manually rotatable to the axial inlet to enable the filter grid to be directionally adjusted to oppose the fixed surface when the assembly is secured to said surface.

2. A bilge pump assembly according to claim 1, wherein the electric motor is enclosed in a cylindrical jacket whose axis is aligned with the shaft and the axis of the tubular portion of the casing.

3. A bilge pump assembly according to claim 2, wherein the jacket has an integral double skin cylindrical outer wall having an opening to said pump chamber to provide an internal closed end passageway between the skins and into which passageway liquid in the casing can flow from said pump chamber to cool the motor.

4. A bilge pump assembly according to claim 1, wherein the casing has two opposed ends, one in which the axial inlet is provided and the other being open and around which a shroud outwardly extends.

5. A bilge pump assembly according to claim 4, wherein the shroud has a plurality of open-ended slots at the transition between the tubular portion and itself and into which slots corresponding lugs, provided on the jacket, are manually pushed and rotated for the motor to be thereby held in position.

6. A bilge pump assembly according to claim 5, wherein at the outer edge of the outer skin of the jacket, an O-ring seal is provided whereby, with the lugs fully located in their respective slots, the O-ring is compressed and distorted to provide a liquidtight seal.

7. A bilge pump assembly according to claim 4, wherein the shroud is of rectangular shape in end elevation of the casing and two adjoining walls thereof are extended and provided with apertures through which fastenings can be screwed or bolted into a surface, the wall extensions and apertures serving as the means for surface-securement.

8. A bilge pump assembly according to claim 1, wherein the inlet housing has a body having an upright wall in which an outlet is provided having a projecting spigot surround, the outer circumferential surface of which has a channel providing a seat for an O-ring seal.

9. A bilge pump assembly according to claim 8, wherein the end of the casing having the axial inlet is provided with an annular socket formed by an outer peripheral flange and an inner peripheral surround extending from around the axial inlet, the space therebetween being entered by the spigot surround.

10. A bilge pump assembly according to claim 9, wherein the outer edge of the outer peripheral flange is tapered from outside to inside to provide a ramp to assist in the compression of the O-ring seal to provide a liquidtight joint between the casing and inlet housing.

11. A bilge pump assembly according to claim 9, wherein the fitment between the spigot surround of the inlet housing with O-ring seal and the socket of the casing, allows the facility to manually adjust the attitude of the filter grid of the housing relative to the surface to which the assembly is to be attached.

12. A bilge pump assembly according to claim 11, wherein the filter grid is removably mounted to the housing for ease in cleaning.

13. A bilge pump assembly according to claim 8, wherein the upright wall is, in inner end view, of sectoral shape and the front outer end slopes downwardly from adjacent to the top of the upright wall to meet and partially serve to define a bottom open arcuate side.

14. A bilge pump assembly according to claim 13, wherein an air bleed valve is provided in the top side between the top of the upright wall and front outer end.

15. A bilge pump assembly according to claim 1, wherein a tubular extension module of the jacket of the motor is provided, the tubular extension module being secured to the jacket by a locking ring and sealed internally with a O-ring.

16. A bilge pump assembly according to claim 15, wherein further for an automatic version of the pump assembly, a water level detector having circuitry is provided and housed in the extension module.

17. A bilge pump assembly according to claim 16, wherein the circuitry of the water level detector includes time delays, motor stall cut-out protection, thermal overheating cut-out protection and sensing circuitry to provide ON/OFF switching for the motor.

18. A bilge pump assembly according to claim 17, wherein the electric motor has electric wires extending from the motor for integration into an electric circuit, the wires passing through the tubular extension module along an axial path or substantially so, or parallel thereto, to exit therefrom through an axial collar with a liquidproof seal being provided between the wires and collar.

19. A bilge pump assembly according to claim 18, wherein a terminal board is interposed for the electric wires of the motor, the board being housed in the tubular extension module.

20. A bilge pump assembly according to claim 19, wherein the terminal board has two sets of components, one set on each planar side of the board whereby on assembly of the pump, the board can be used either way up depending on which one of two alternative axial-lengthed motors is to be used.

21. A bilge pump assembly according to claim 18, wherein the collar has two diametrically-extending wing gussets between itself and the end wall of the tubular extension module to give it support and to aid in disassembly.

22. A bilge pump assembly according to claim 21, wherein two water-level sensors are provided in spaced relationship in the end wall of the tubular extension module to be located, in use, above the wing gussets, one above each wing gusset.

23. A bilge pump assembly according to claim 22, wherein the sensors are rods of non-corroding material mounted in bosses, the rods having polished conical ends.

24. An electric bilge pump assembly as in claim 1, wherein the assembly is fixed to a surface of a water craft in a horizontal attitude or substantially so.

* * * * *